US012345052B2

(12) United States Patent
Stackhouse et al.

(10) Patent No.: US 12,345,052 B2
(45) Date of Patent: Jul. 1, 2025

(54) SYSTEM FOR FLASHING END JOINTS OF SIDING

(71) Applicant: LOUISIANA-PACIFIC CORPORATION, Nashville, TN (US)

(72) Inventors: David L. Stackhouse, Nashville, TN (US); Matthew E. Vrazel, Nashville, TN (US); G. Paul Merrick, Jr., Newberry, MI (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 278 days.

(21) Appl. No.: 18/134,468

(22) Filed: Apr. 13, 2023

(65) Prior Publication Data

US 2023/0332415 A1 Oct. 19, 2023

Related U.S. Application Data

(60) Provisional application No. 63/330,365, filed on Apr. 13, 2022.

(51) Int. Cl.
*E04F 13/08* (2006.01)

(52) U.S. Cl.
CPC ..... *E04F 13/0898* (2013.01)

(58) Field of Classification Search
CPC ..... E04F 13/0898; E04F 13/0846; E04F 13/0894; E04F 13/0864; E04F 13/0889; E04F 21/1855; E04F 19/061; E04B 1/64
See application file for complete search history.

(56) References Cited

U.S. PATENT DOCUMENTS 1,379,516 A * 5/1921 Benjamin ..... E04B 1/62 105/396
3,164,511 A * 1/1965 Elmendorf ..... E04C 2/16 428/218
4,364,984 A * 12/1982 Wentworth ..... B32B 7/12 428/326
4,485,600 A * 12/1984 Olson ..... E04F 13/10 52/62

(Continued)

OTHER PUBLICATIONS

Search Report and Written Opinion for PCT/US2023/018548 (10 pages). (Year: 2023).*

*Primary Examiner* — Rodney Mintz
(74) *Attorney, Agent, or Firm* — Wayne Edward Ramage; Baker Donelson

(57) ABSTRACT

A system, flashing apparatus, and associated methods for protecting vertical butt joints in installed siding having locking profiles. The lower profiled edge of the siding is modified proximate the ends during manufacture or in a factory setting to create a modified section configured to mate with a unique piece of factory-produced or pre-made flashing of similar or matching profile. The flashing piece fits with the ends of the adjacent siding boards in a horizontal row and aligns with the profile of the locking edges of vertically adjacent siding boards so the system sheds water effectively and prevents water from penetrating behind the siding. In addition, the factory-modified siding and the pre-manufactured flashing pieces may be supplied as a ready-to-install system that simplifies the siding installation process and shortens the time and cost of installation.

13 Claims, 8 Drawing Sheets

(56) References Cited

U.S. PATENT DOCUMENTS 5,425,976 A * 6/1995 Clarke ..... B32B 7/03 428/218
5,470,631 A * 11/1995 Lindquist ..... B27N 3/04 428/218
5,525,394 A * 6/1996 Clarke ..... B32B 38/06 428/218
5,718,786 A * 2/1998 Lindquist ..... B27N 3/04 428/218
5,884,435 A * 3/1999 David ..... E04F 19/061 52/302.6
5,894,697 A * 4/1999 Hunter ..... E04D 13/02 52/302.6
6,301,849 B1 * 10/2001 Roth ..... A01M 1/026 52/302.1
6,308,470 B1 * 10/2001 Durkovic ..... E04B 1/70 405/36
6,461,743 B1 * 10/2002 Tanzer ..... B27N 7/005 428/528
6,786,011 B2 * 9/2004 Mares ..... E04D 13/1478 52/60
7,721,488 B1 * 5/2010 Bennett ..... E04F 13/0864 52/302.6
7,784,222 B2 * 8/2010 Bennett ..... E04F 13/0864 52/518
9,109,369 B2 * 8/2015 Schaefer ..... E04F 13/0864
9,200,456 B2 * 12/2015 Murphy ..... E04F 13/0801
9,624,675 B2 * 4/2017 Schaefer ..... E04F 13/0837
9,951,514 B2 * 4/2018 Debuff ..... E04F 19/00
10,060,126 B2 * 8/2018 Collins ..... E04B 2/28
10,301,816 B2 * 5/2019 DeBuff ..... E04F 13/0887
10,544,578 B2 * 1/2020 DeBuff ..... E04F 13/148
10,900,221 B2 * 1/2021 McEndree ..... E04F 21/1855
11,131,098 B1 * 9/2021 Matuszewski ..... E04F 19/061
12,037,797 B2 * 7/2024 Matuszewski ..... E04F 19/061
2004/0093806 A1 * 5/2004 Mares ..... E04D 13/1415 52/62
2007/0054086 A1 * 3/2007 Pagel ..... E04B 1/003 428/106
2007/0055007 A1 * 3/2007 Pagel ..... E04B 1/003 524/569
2007/0157528 A1 * 7/2007 Gawoski ..... E06B 1/62 52/58
2009/0064599 A1 * 3/2009 Bennett ..... E04F 13/0864 52/60
2009/0241458 A1 * 10/2009 Das ..... E04F 13/0876 52/796.1
2010/0218434 A1 * 9/2010 Bennett ..... E04F 13/0864 52/302.6
2011/0197520 A1 * 8/2011 Preston ..... E04D 3/40 428/339
2014/0013696 A1 * 1/2014 Murphy ..... E04F 13/0869 52/489.1
2014/0020319 A1 * 1/2014 Marchese ..... E04F 13/0837 52/302.3
2014/0208679 A1 * 7/2014 Schaefer ..... E04F 13/0832 52/748.11
2014/0260048 A1 * 9/2014 Schaefer ..... E04F 13/0878 52/741.1
2016/0040435 A1 * 2/2016 Schaefer ..... E04F 13/0864 52/704
2017/0081840 A1 * 3/2017 DeBuff ..... E04B 1/64
2017/0226732 A1 * 8/2017 Collins ..... E04B 1/765
2018/0127974 A1 * 5/2018 DeBuff ..... E04B 1/68
2018/0216340 A1 * 8/2018 DeBuff ..... E04B 1/64
2020/0199865 A1 * 6/2020 McEndree ..... E04F 21/1855
2022/0010561 A1 * 1/2022 Matuszewski ..... E04F 13/0898
2022/0372749 A1 * 11/2022 Ni ..... C09K 21/04
2023/0228099 A1 * 7/2023 Stackhouse ..... E04F 13/0894 52/588.1

* cited by examiner

Figure 1. Front view of siding with flashing shown behind

Figure 2. Rear view of siding with flashing and notch shown

Figure 3. Cross section through siding at the joint showing blind nailing

SYSTEM FOR FLASHING END JOINTS OF SIDING

This application claims benefit of and priority to U.S. Provisional App. No. 63/330,365, filed Apr. 13, 2022, which is incorporated herein in its entirety by specific reference for all purposes.

FIELD OF INVENTION

This invention relates to a flat siding product with a unique end-joint flashing treatment.

BACKGROUND OF INVENTION

Flat siding is an exterior cladding product that may be installed in horizontal, vertical or diagonal orientations. It may be installed fully flush with the wall. It may come in various dimensions (e.g., ½" thick×8" wide×16' long), with various surface textures (e.g., smooth, cedar, and the like). It may be fashioned of various materials, including, but not limited to, sawn wood, engineered wood composites of various types, cellulose fiber cement, or combinations thereof. Oriented, multilayer wood strand boards of the above-described type, and examples of processes for pressing and production thereof, are described in detail in U.S. Pat. Nos. 3,164,511, 4,364,984, 5,425,976, 5,470,631, 5,525,394, 5,718,786, 6,461,743, and U.S. patent application Ser. No. 17/747,930, all of which are incorporated herein in their entireties by specific reference for all purposes.

Installation of flat siding products present a unique challenge when the aesthetic desire for a "blind nail" attachment (i.e., the nail head is not visible and does not penetrate the outer surface of the siding) is coupled with the engineering need to withstand local building code requirement for specified wind loads (i.e., so that adjacent pieces remain fully flush on the wall and resist being pulled away or detached from the wall). Various modifications of a shiplap or tongue-and-groove joint profile with locking edges may be used to secure the two adjacent products. However, the locking flanges or profile elements of the respective joint edges prevent prior-art flashing devices from directing water out and away from the end joint, which typically is a flat or butt joint with respect to the siding boards meeting end-to-end.

SUMMARY OF INVENTION

In various exemplary embodiments, the present invention modifies the ends of the siding, during manufacture or in a factory setting, to adjust the locking flange profile. This allows the ends and edges to precisely mate with a unique piece of factory-produced or pre-made flashing of similar or matching profile. Thus, the flashing piece fits with the ends of the adjacent siding boards and aligns with the profile of the locking edges so the system sheds water effectively and prevents water from penetrating behind the siding. In addition, the factory-modified siding and the pre-manufactured flashing pieces are supplied as a ready-to-install system that simplifies the siding installation process and shortens the time and cost of installation.

DETAILED DESCRIPTION OF EXEMPLARY EMBODIMENTS

In several exemplary embodiments, the present invention comprises a system, method, and associated flashing device(s). Portions of the lower edge proximate the ends of siding pieces 2L, 2R (for the left piece and right piece, respectively) are modified as discussed below, and the joints between the ends are backed by a unique flashing piece during installation. The upper edges 10 and lower edges 12 of each siding piece form corresponding profiled portions of a locking flange joint 20. The locking flange joint is formed when an upper siding piece (or row of siding pieces) is installed above a lower siding piece.

An example of a locking flange joint system with a modified shiplap joint is described in U.S. patent application Ser. No. 18/097,447, filed Jan. 16, 2023, which is incorporated herein in its entirety by specific reference for all purposes. That reference discloses a unique modified shiplap joint with matching or corresponding reverse curves (S-curve), where two simple curves turn in opposite directions (e.g., a first curve followed immediately by a second curve in the opposite direction). The opposing edges or ends of a piece of flat siding comprise one-half of the modified shiplap joint: an underlap edge, and an overlap edge. In a horizontal configuration, the underlap is the top edge of the siding, and the overlap is the lower edge of the siding, so that when two siding pieces are assembled, any water or moisture on the exterior of the siding will run down the exterior side or face of the siding, and not enter or flow into the joint and thus potentially get behind the siding. The ends of the siding pieces on the same row form vertical butt joints, often with a gap between the ends. While the present invention may be used with the locking flange joint system with a modified shiplap joint as described in U.S. patent application Ser. No. 18/097,447, the present invention may be used other form of joint systems with adjustments made to match the adjusted joint profiles.

Figure 1:
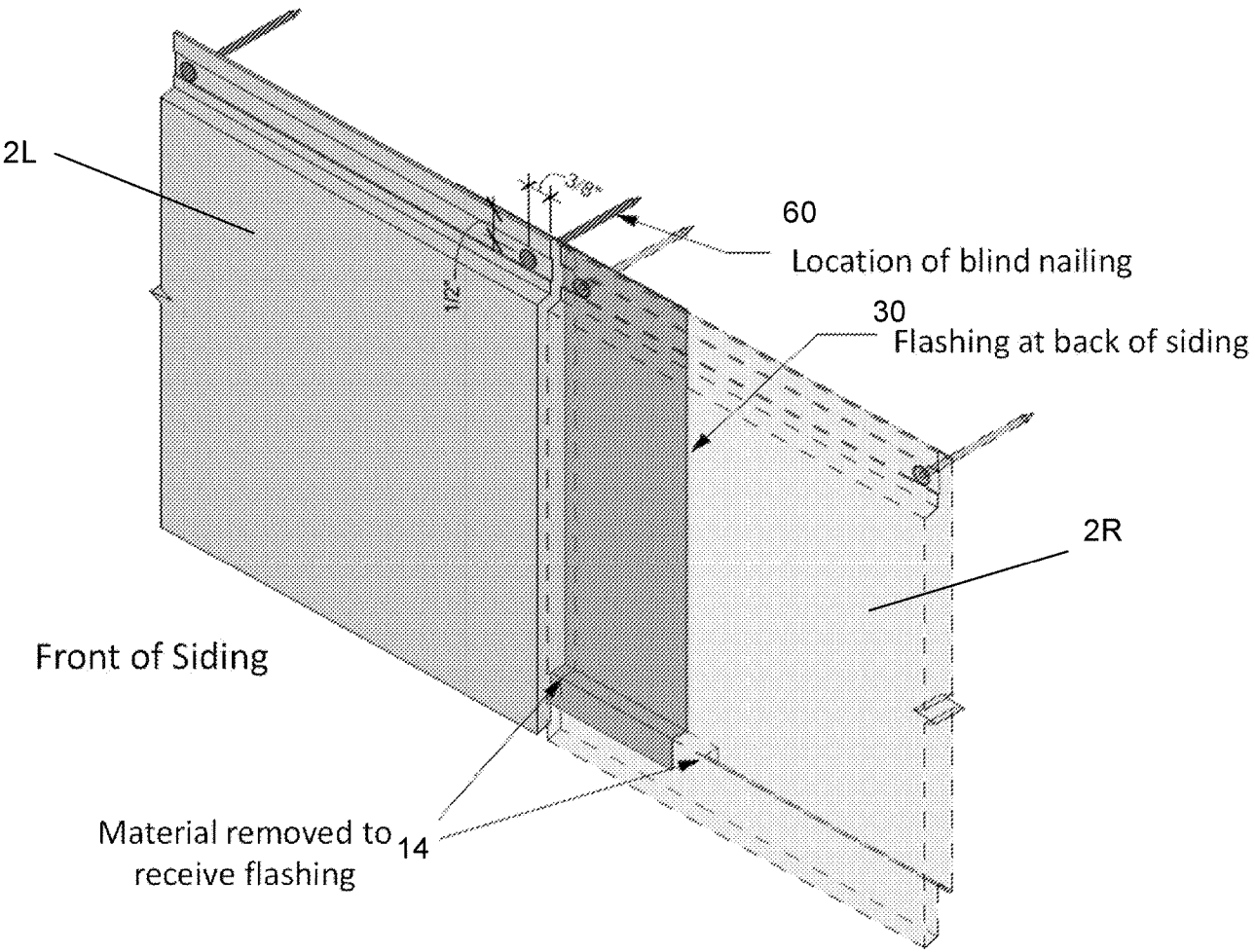
FIG. 1 shows a front partial perspective view of a flashing piece with a "dog-leg" lower edge in accordance with an embodiment of the present invention, installed behind the joint between the ends of two pieces of siding.
Figure 2:
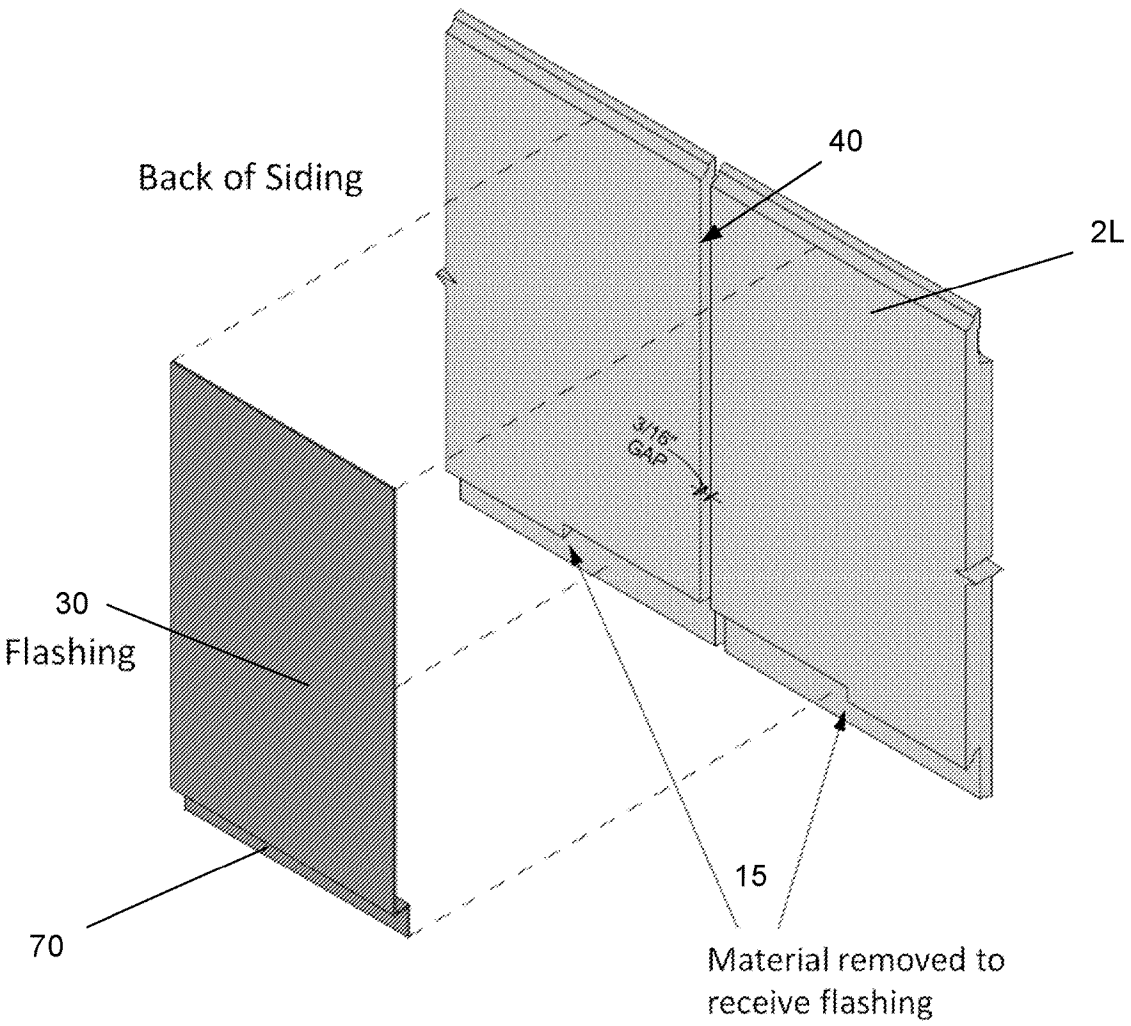
FIG. 2 shows a back partial perspective view of FIG. 1, with the flashing piece away from the two pieces of siding.
Figure 3:
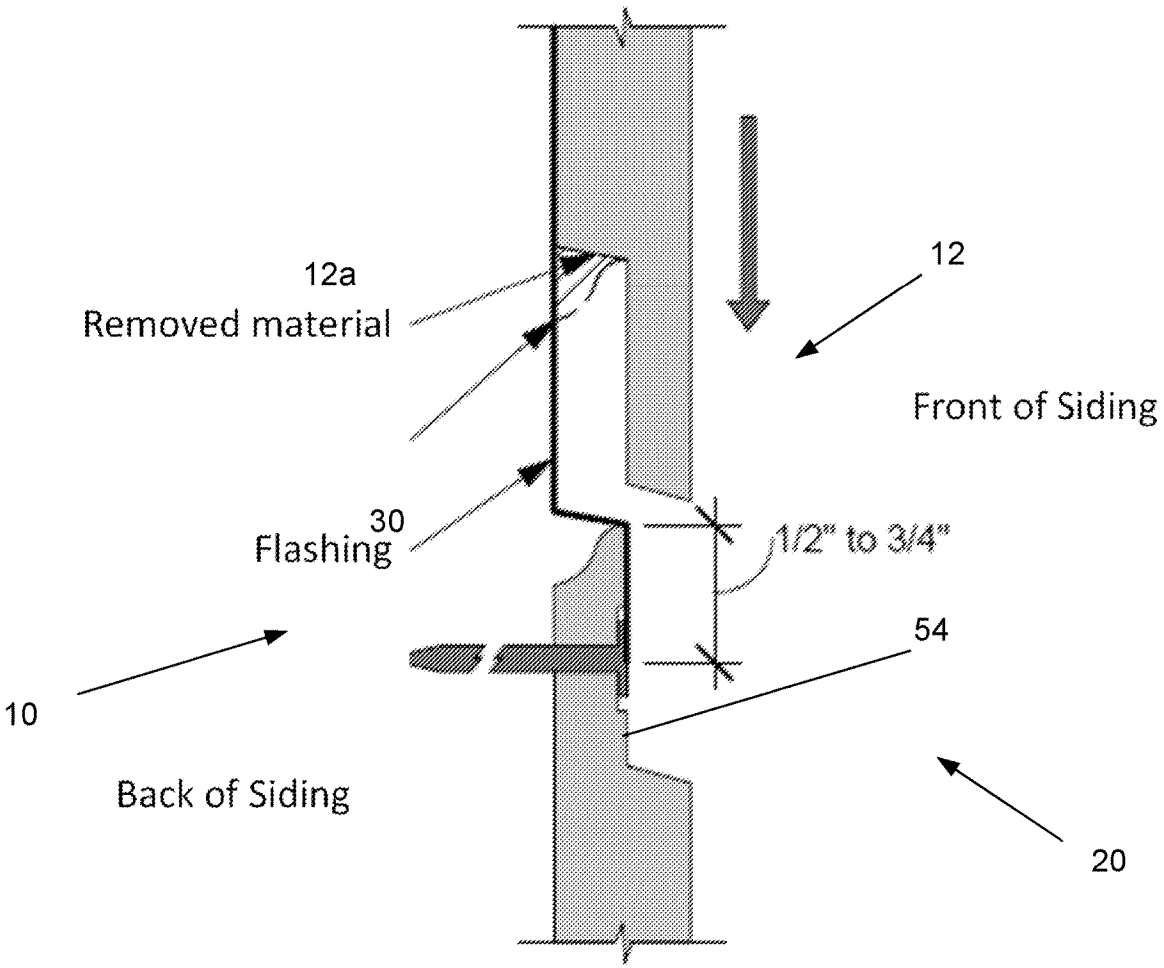
FIG. 3 shows a side cutaway view of the flashing piece of FIG. 1 inserted between an upper piece of siding and a lower piece of siding, prior to sliding the upper piece of sliding downward to form the profile joint with the lower piece of siding.

According to several embodiments of the present invention, the profiled joint portion along the lower edge 12 of the siding pieces is adjusted or modified during manufacture of the siding piece in the factory, or after manufacture but in a factory setting. As seen in FIG. 3, a portion of material 12*a* is absent, not present, or removed from the profiled joint section, for a modified section 14 proximate the end. As seen in FIG. 1, approximately 2.5 inches of the locking tab or spline for the "underlap" or "lower" component of a locking joint at the ends of the siding has been removed, although the actual distance may vary, as described below. Doing this at the factory or during the manufacturing process has the advantage of allowing a precise removal or cut. An improper cut, such as a joint flange being too deeply or improperly cut, could weaken the siding product and affect its performance.

In several embodiments, the top cut 14*b* of the modified section 14 may be orthogonal to the rear siding face, or angled downward (from back to front, so the front of the cut is lower). The angle of the top 72 of the (i.e., "dog-leg") double-bent portion 70 of the flashing is selected to fit within this modified section. The angle of the top 72 may match the angle of the top cut 14*b*, or may be larger or smaller, thereby providing a space between the top cut and the top of the dog-leg to help prevent water from being trapped therein.

When two ends are placed adjacent to other, the respective modified section 14 of each end match, and together form a flashing space or area 15 of sufficient length to receive the double-bent (i.e., "dog-leg") portion 70 of the flashing piece 30 lower edge, and allow the double-bent portion to fit within the siding pieces and in front of the corresponding profiled joint portion along the upper edge 10 of the siding piece or pieces 4 below.

While the distances the modified sections extend from their respective ends may differ, in a preferred embodiment the distances are the same so that the flashing piece 30 is effectively centered on the vertical butt joint 40. The distances are chosen such that they are sufficient when the siding is installed, including an appropriate gap in the butt joint 40, to precisely accommodate the width of the flashing piece comfortably but without allowing lateral movement, or significant lateral movement, of the flashing when in place.

During installation, a lower row of siding is installed by driving or inserting a nail or other fastener 62 into the top flange of the upper edge 10, which may have a groove or channel 60, when each piece of siding is mounted on a building or structure frame or sheathing. This forms a "blind nail" attachment when the overlap end of the vertically adjacent piece of siding is placed over this area (and thus the nail head 64 cannot be seen). The depth of the groove or channel is such as to accommodate the nail or fastener head 64 (i.e., the top of the nail or fastener head does not extend above the front face 54 of the underlap), and allows the overlap portion, and thus the adjacent pieces of siding, to lie flat when the joint 20 is formed.

The next (upper) row of siding is installed above the previous row by each upper piece of siding placed above the lower pieces and moved downward so the profiled joint portion along the bottom edge enters and engages the corresponding profiled joint portion along the upper edges of the lower pieces of siding. During this process, the flashing pieces are inserted at the ends of the upper piece so that the lowermost leg 72 of the "dog-leg" 70 fits over some or all of the front face 54 of the underlap portion of the upper edge joint profile. The lowermost leg 72 may extend partially or completely over the nail or fastener head 64 and/or channel 60. In a preferred embodiment, the lowermost leg 72 at least downward past the point where the upper edge of the lower piece of flashing in that area extends. The upper siding pieces are then nailed or fastened into place, in the same manner described above.

Figure 5:
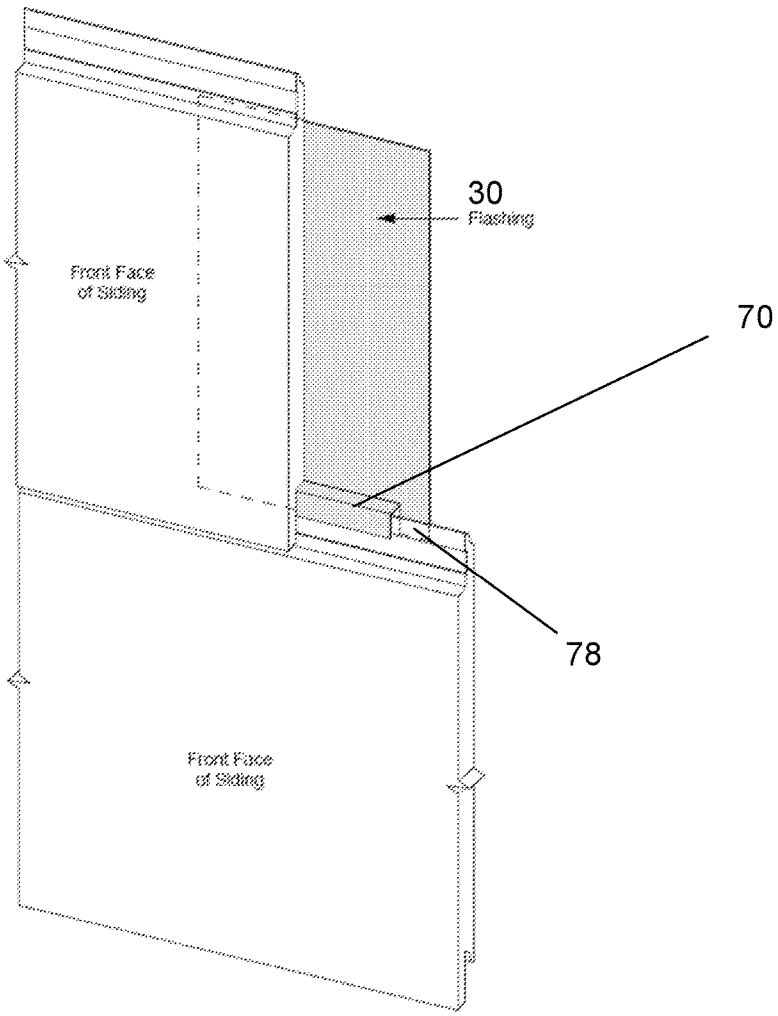
FIG. 5 shows a front partial perspective view of the flashing piece of FIGS. 4A-B installed behind the joint between the ends of two upper pieces of siding, and above a continuous portion of a lower piece of siding.

As shown in FIG. 5, the upper siding pieces are installed such that the vertical butt joints of a row are offset from the vertical butt joints of the adjacent rows. However, in some installations, the vertical butt joints for two or more adjacent rows may be aligned.

In some embodiments, the flashing piece may not be fastened to any siding piece or to the building or structure frame or sheathing. The lack of penetrations in the flashing help prevent water or moisture from penetrating into the frame or sheathing behind the siding. In other embodiments, the flashing piece may be fastened proximate its upper edge by nails or fasteners as described above. In a preferred embodiment, where the flashing piece extends to or near the height of the back edge of the respective piece of siding, the "blind nail" used to fasten the siding also acts to fasten the flashing piece, as seen in FIG. 1.

Figure 4B:
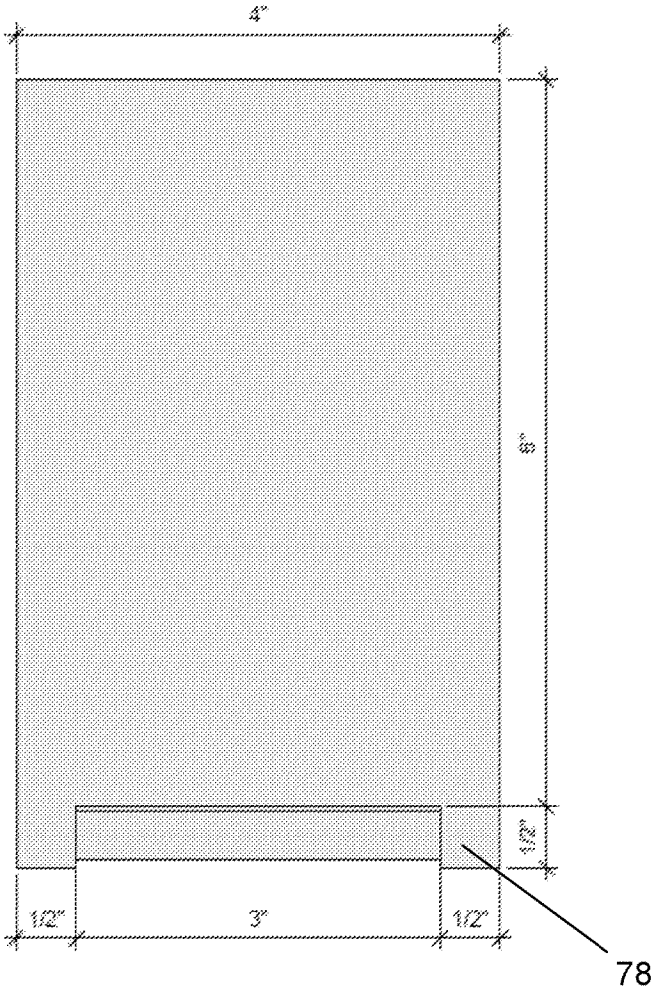
FIGS. 4A-B show front partial perspective views of an embodiment of a flashing piece where only a portion of the lower edge form a "dog-leg," with two tabs on the lower edge to either side.
Figure 4A:
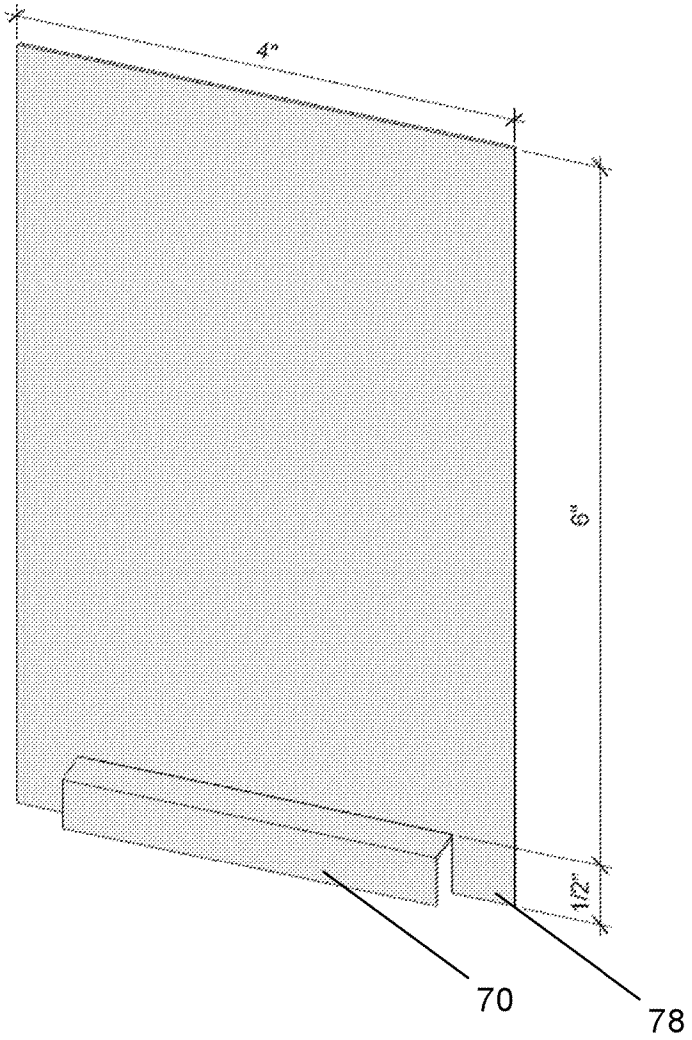
Figure 6:
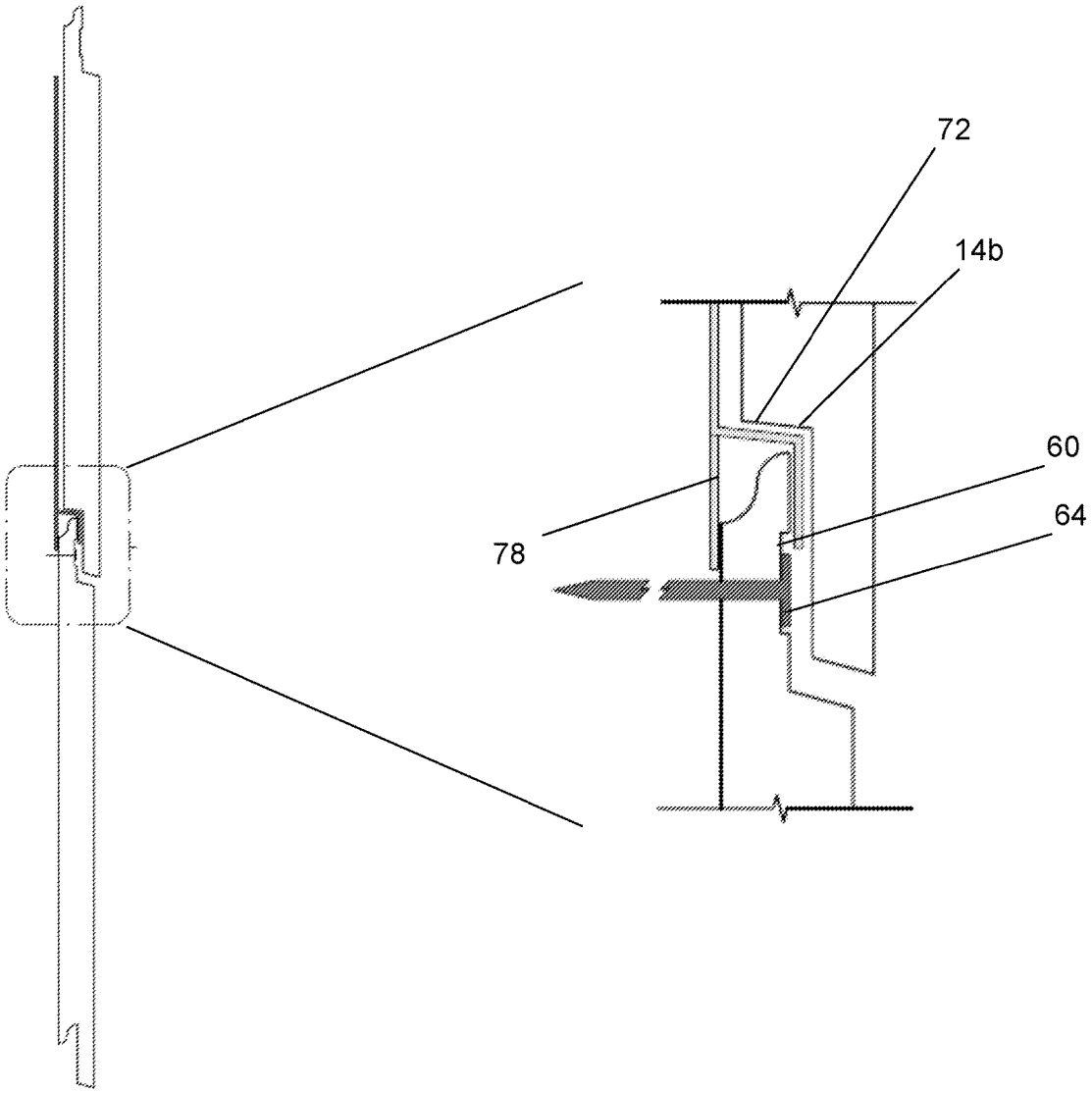
FIG. 6 shows a side cutaway view of the configuration of FIG. 5, after sliding the upper piece of siding downward to begin forming the profile joint with the lower piece of siding (note that spacing between elements is not necessarily to scale).

FIGS. 4A-B through 6 show another embodiment of the flashing. In this embodiment, the dog-leg portion 70 does not extend the full width of the bottom edge of the flashing 30, but instead extends only across a center portion, while two tabs 78 parallel to and continuous with the main flashing section extend downward. The tabs 78 extend downward behind the profiled upper edge of the adjacent lower piece of siding, which increases stability of the flashing and eases placement and installation, thereby reducing time and expense of installation. The tabs are shown as being ½" in width, but may be of any suitable width and configuration.

Figure 7:
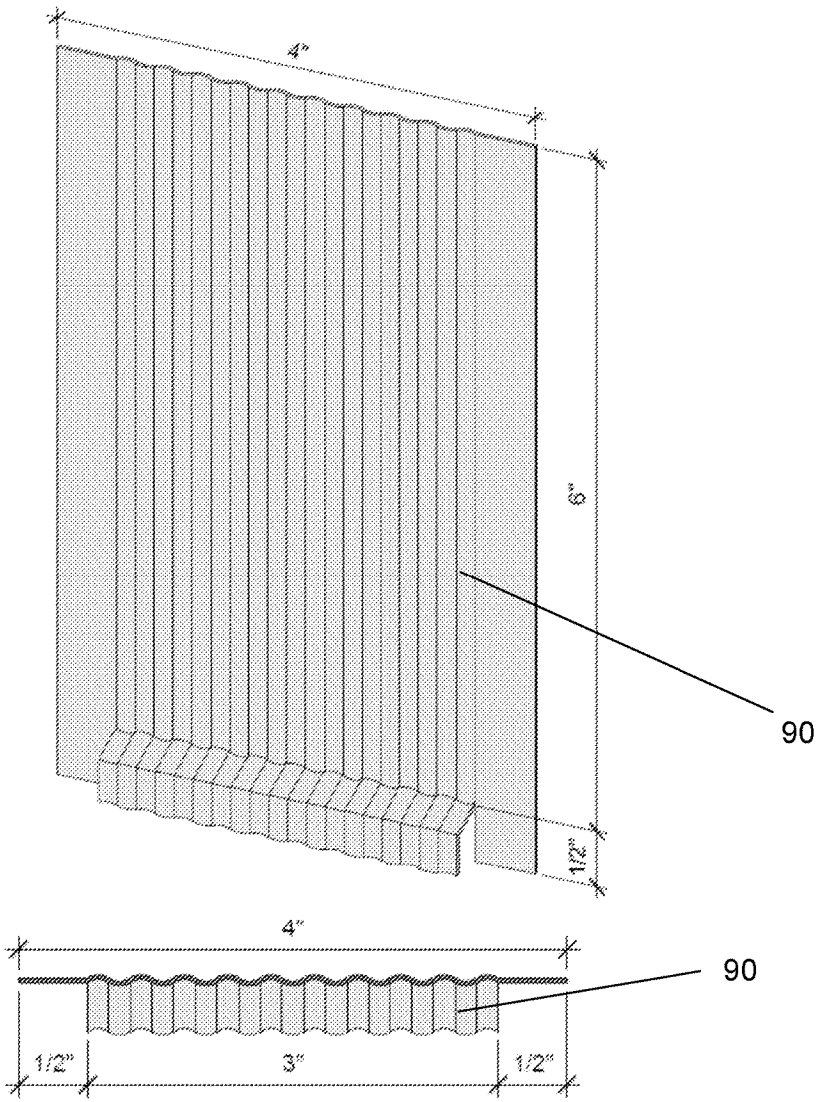
FIG. 7 shows a front perspective of another embodiment of the flashing piece of FIGS. 4A-B, with the "dog-leg" section and the area of the flashing above it being corrugated.
Figure 8:
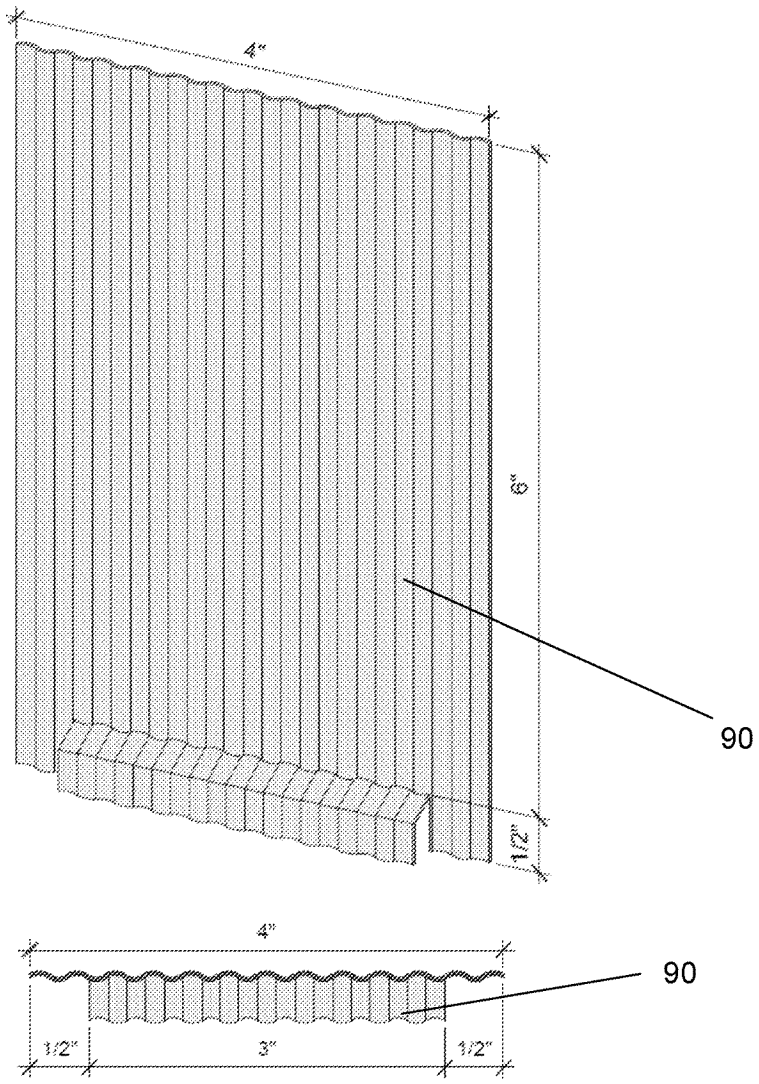
FIG. 8 shows a front perspective of another embodiment of the flashing piece of FIGS. 7, but fully corrugated.

FIGS. 7 and 8 show a further embodiment where some (i.e., partial) or all of the flashing is corrugated 90 (i.e., wavy, alternating curves, or with sine waves in cross-section). FIG. 7 shows the corrugation on the dog-leg and extending upward therefrom to the upper edge of the flashing. FIG. 8 shows the corrugation on the entirety of the flashing. The corrugation helps create a series of channels or space between the flashing and siding faces, thereby promoting the flow of water down the flashing and outward in the butt joint area. The width and depth of the channels may vary as needed, depending on the configuration.

Accordingly, this system allows the ends and edges of the adjacent pieces of siding (horizontally and vertically) to precisely mate with a piece of factory-produced or pre-made flashing of similar profile. Thus, the flashing piece fits with the ends of the adjacent siding boards and aligns with the profile of the locking edges so the system sheds water effectively and prevents water from penetrating behind the siding. The bottom edge of the flashing piece is twice bent, as described above, forming a sloped profile that may match the slope of the top cut. The "leg" section past the sloped profile is generally parallel to the main section and extends downward along the outer face of the "underlap" component, and between it and the inner face of the "overlap" component. In one exemplary embodiment, the flashing piece is 6¾" in length for the main pan section, the sloped section is ¾" long, and the leg section is ½" long. In addition, the factory-modified siding and the pre-manufactured flashing pieces may be supplied as a ready-to-install system that simplifies the siding installation process and shortens the time and cost of installation.

The prefabricated flashing piece comprises corrosion and fire-resistant metal flashing, configured to align with the modified bottom edge of the siding, and the profile of the top edge of the adjacent piece of siding (typically the lower piece of siding). Flexible, fabric-style flashing is not suitable for open joints that expose the flashing to UV and fire. In one embodiment, the flashing piece is approximately 4 inches in width, which allows it to fit within the total of approximately 5 inches of flashing gap (2½" inches per piece, plus a gap between the ends, which may be approximately 3/16").

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A flashing system for use with siding having locking profiled edges, comprising:

a plurality of pieces of siding, each piece of siding comprises a length, a front face, a back face, a top edge, a bottom edge, a first end, and a second end, said top edge comprising an underlap portion defining a first portion of a locking profiled joint, and said bottom edge comprising an overlap portion defining a second portion of the locking profiled joint, wherein the top edge and bottom edge of vertically adjacent pieces of siding fit together to collectively define the locking profiled joint, and the first end and second end of horizontally adjacent pieces of siding collectively define a butt joint;

a plurality of pieces of metal flashing, each piece of flashing having a length and a width, a front face, a back face, a top edge, a bottom edge, opposing ends, and a center, wherein said bottom edge of each piece of flashing comprises a dog-leg portion with a first bend and a second bend in an opposite direction from the first bend, with a first leg located between the first bend and the second bend, and a second leg extending beyond the second bend;

wherein the bottom edge of each piece of siding comprises a modified joint section where the second portion of the locking profiled joint is absent or has been removed proximate to both the first end and the second end;

wherein the modified joint sections of respective said horizontally adjacent pieces of siding jointly define a recessed flashing space configured to receive the pieces of metal flashing;

wherein each piece of metal flashing is configured to be placed behind a respective said butt joint with the dog-leg portion snuggly fitting within the recessed flashing space, and the second leg extending downward over a portion of or all of a front of the underlap portion of a respective said vertically adjacent piece of siding.

2. The flashing system of claim 1, wherein the second leg extends downward over a head of a fastener penetrating the underlap portion of a respective said vertically adjacent piece of siding.

3. The flashing system of claim 1, wherein the top edge of the pieces of flashing extend to or proximate to the top edge of the respective pieces of siding.

4. The flashing system of claim 1, wherein a fastener used to fasten a respective said piece of siding to a building or structure also penetrates the respective piece of flashing.

5. The flashing system of claim 1, wherein each piece of flashing is corrugated or wavy in cross-section, in whole or in part.

6. The flashing system of claim 1, wherein the dog-leg portion of each piece of flashing is corrugated or wavy in cross-section.

7. The flashing system of claim 1, wherein the dog-leg portion extends an entirety of the length of the bottom edge of each piece of flashing.

8. The flashing system of claim 1, wherein the dog-leg portion extends only part of the length of the bottom edge of each piece of flashing.

9. The flashing system of claim 8, wherein the dog-leg portion extends across the center and does not reach either end of each piece of flashing.

10. The flashing system of claim 9, where respective portions of the bottom edge of each piece of flashing not included in the dog-leg portion extend downward, and are configured to extend downward behind the underlap portion of the respective vertically adjacent piece of siding.

11. The flashing system of claim 1, wherein each modified joint section comprises a top cut angle projecting downward towards the front face of the respective piece of siding.

12. The flashing system of claim 11, wherein the first leg of each piece of flashing comprises a first leg angle projecting downward towards the front face of the respective piece of siding.

13. The flashing system of claim 12, wherein the top cut angle and the first leg angle are a same angle.

* * * * *